US012344968B2

(12) United States Patent
Izawa

(10) Patent No.: US 12,344,968 B2
(45) Date of Patent: Jul. 1, 2025

(54) TOWEL CLOTH AND METHOD OF PRODUCING THE SAME

(71) Applicant: IZAWA TOWEL CO., LTD., Tokyo (JP)

(72) Inventor: Shoji Izawa, Tokyo (JP)

(73) Assignee: IZAWA TOWEL CO., LTD., Tokyo (JP)

( * ) Notice: Subject to any disclaimer, the term of this patent is extended or adjusted under 35 U.S.C. 154(b) by 0 days.

(21) Appl. No.: 18/565,958

(22) PCT Filed: Oct. 11, 2022

(86) PCT No.: PCT/JP2022/037844

§ 371 (c)(1),
(2) Date: Nov. 30, 2023

(87) PCT Pub. No.: WO2023/074347

PCT Pub. Date: May 4, 2023

(65) Prior Publication Data

US 2024/0263366 A1 Aug. 8, 2024

(30) Foreign Application Priority Data

Oct. 25, 2021 (JP) ..... 2021-173731

(51) Int. Cl.
*D03D 27/08* (2006.01)
*D03D 15/217* (2021.01)
(Continued)

(52) U.S. Cl.
CPC ..... *D03D 27/08* (2013.01); *D03D 15/217* (2021.01); *D03D 15/283* (2021.01); *D03D 15/47* (2021.01);
(Continued)

(58) Field of Classification Search
CPC .... D03D 27/08; D03D 15/217; D03D 15/283; D03D 15/47; D03D 39/22; D03D 1/0017;
(Continued)

(56) References Cited

U.S. PATENT DOCUMENTS 7,081,423 B2 * 7/2006 Abed ..... D04H 1/43828 442/364
7,799,968 B2 * 9/2010 Chen ..... B32B 29/00 604/377
(Continued)

FOREIGN PATENT DOCUMENTS

JP H0674350 B2 9/1994
JP 2018-057499 A 4/2018
(Continued)

OTHER PUBLICATIONS

International Search Report of the International Searching Authority directed to related International Patent Application No. PCT/JP2022/037844, mailed Dec. 27, 2022, with attached English-language translation; 4 pages.

*Primary Examiner* — Robert H Muromoto, Jr.
(74) *Attorney, Agent, or Firm* — Sterne, Kessler, Goldstein & Fox P.L.L.C.

(57) ABSTRACT

There are provided a towel cloth for which gluing is unnecessary during weaving and a method of producing the same. The towel cloth includes warp pile yarns, warp ground yarns, and weft ground yarns. The warp pile yarns are core-sheath conjugate spun yarns or bundled spun yarns. The core component fibers are polyester multifilament yarns. The sheath component fibers are cotton fibers. The sheath component fibers include untwisted fibers and wrapped fibers on the surface thereof, and the wrapped fibers are wound in one direction to bundle all components. The warp pile yarns have a tenacious yarn structure, are strong against squeezing, and can be formed into a towel cloth
(Continued)

without glue. This towel cloth is resistant to fluff dropping and has favorable water absorption and texture, and also has a fast drying speed.

8 Claims, 8 Drawing Sheets

(51) Int. Cl.
*D03D 15/283* (2021.01)
*D03D 15/47* (2021.01)
*D03D 39/22* (2006.01)
*D03D 1/00* (2006.01)

(52) U.S. Cl.
CPC ..... *D03D 39/22* (2013.01); *D10B 2201/02* (2013.01); *D10B 2331/04* (2013.01)

(58) Field of Classification Search
CPC ..... D03D 27/06; D03D 1/00; D03D 13/008; D03D 15/44; D10B 2201/02; D10B 2331/04; D10B 2503/00; A47K 10/02; D02G 3/36
See application file for complete search history.

(56) References Cited

U.S. PATENT DOCUMENTS

| | | | | |
|---|---|---|---|---|
| 8,030,231 | B2 * | 10/2011 | Lange | D04H 1/74 442/403 |
| 9,334,608 | B2 * | 5/2016 | Ogata | D06M 13/188 |
| 10,072,365 | B2 * | 9/2018 | Birk | D04B 1/14 |
| 11,383,479 | B2 * | 7/2022 | Vatter | A61Q 5/00 |
| 11,486,065 | B2 * | 11/2022 | Goenka | D03D 15/47 |
| 2020/0040491 | A1 * | 2/2020 | Mittal | D03D 15/47 |
| 2023/0374708 | A1 | 11/2023 | Izawa et al. | |

FOREIGN PATENT DOCUMENTS

| | | |
|---|---|---|
| JP | 2018-188783 A | 11/2018 |
| JP | 2021-050462 | 4/2021 |
| WO | WO 2018/182567 | 10/2018 |

* cited by examiner

TOWEL CLOTH AND METHOD OF PRODUCING THE SAME

TECHNICAL FIELD

The present invention relates to a towel cloth and a method of producing the same.

BACKGROUND ART

Conventionally, towel cloths are made using warp pile yarns, warp ground yarns, and weft ground yarns, and are basically pile fabrics. In the weaving process, yarn-dyed yarns are glued in the cheese-wrapped state after yarn dyeing (stock dyeing), and in the case of piece dyed yarns, warp ground yarns and warp pile yarns are warped and glued in a beam-wound state (a roughly wound beam). Warp ground yarns and warp pile yarns are passed through heddles and reeds, and weft ground yarns are weaved into a fabric. Warp ground yarns and warp pile yarns are easily damaged due to friction when they are passed through heddles and reeds, and the amount of fluff and fallen fibers increases. In order to prevent warp ground yarns and warp pile yarns from rubbing against each other and becoming fluff and to prevent yarn breakage during weaving, gluing is necessary. Patent Documents 1 to 2 propose gluing warp pile yarns and warp ground yarns. Patent Document 3 proposes a bundle spinning device.

CITATION LIST

Patent Document

Patent Document 1: Japanese Patent Application Publication No. 2018-188783

Patent Document 2: Japanese Patent Application Publication No. 2018-057499

Patent Document 3: Japanese Examined Patent Publication No. H6-74530

SUMMARY

Technical Problem

However, in the glued yarns in the above conventional technology, it is necessary to remove the glue after the yarns are formed into a towel, and a desizing agent (amylase), a surfactant, other chemical agents, water and the like are necessary, which results in high cost, with a small amount of glue often remaining even after washing, and quality problems such as deterioration in texture and water absorption.

In order to solve the above conventional problems, the present invention provides a towel cloth for which gluing is unnecessary during weaving and a method of producing the same.

Solution to Problem

A towel cloth of the present invention is a towel cloth composed of warp pile yarns, warp ground yarns, and weft ground yarns, wherein the warp pile yarns are core-sheath conjugate spun yarns, core component fibers are polyester multifilament yarns, sheath component fibers are cotton fibers, and some surface layer fibers of the sheath component fibers are wound in one direction to bundle all components.

A method of producing a towel cloth of the present invention is a method of producing the towel cloth, including ungluing all of warp pile yarns, warp ground yarns and weft ground yarns and weaving them into a towel cloth using a loom.

Advantageous Effects of Invention

In the towel cloth of the present invention, warp pile yarns are core-sheath conjugate spun yarns, core component fibers are polyester multifilament yarns, sheath component fibers are cotton fibers, and some surface layer fibers of the sheath component fibers are wound in one direction to bundle all components. Therefore, the yarns have a strong yarn structure, are strong against squeezing, and can be formed into a towel cloth without glue, and it is possible to provide a towel cloth which has favorable texture and does not have a problem of quality deterioration. In addition, as described above, since the warp pile yarns have a strong yarn structure, they are formed into a towel that is resistant to fluff dropping. In addition, cotton fibers are arranged on the surface of warp pile yarns so that the water absorption and texture become favorable, and the core component fibers are polyester multifilament yarns so that the drying speed is fast.

DESCRIPTION OF EMBODIMENTS

Figure 1:
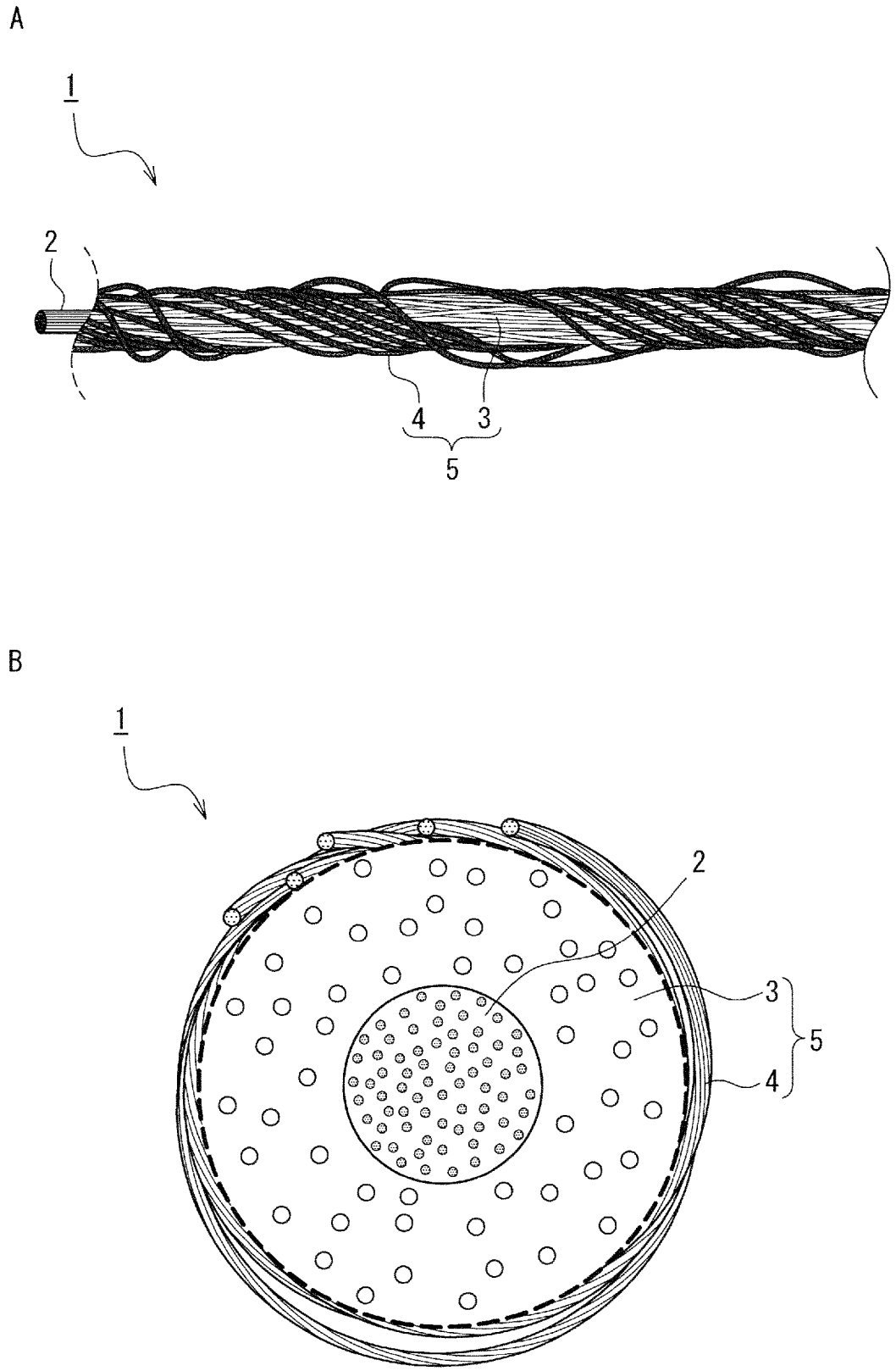
FIG. 1A is a schematic side view of warp pile yarns according to one embodiment of the present invention.
FIG. 1B is a schematic cross-sectional view of the same yarns.

A towel cloth according to one embodiment of the present invention is composed of warp pile yarns, warp ground yarns, and weft ground yarns. The warp ground yarns and weft ground yarns form a ground structure, and the warp pile yarns form a pile (loop). The warp pile yarn is a core-sheath conjugate spun yarn, and core component fibers are polyester multifilament yarns, sheath component fibers are cotton fibers, and some surface layer fibers of the sheath component fibers are wound in one direction to bundle all components. Thereby, the yarns have a small amount of fluff and are uniform, have a strong yarn structure, are strong against squeezing, and can be formed into a towel cloth without glue (unglued), and thus it is possible to provide a towel cloth which has favorable texture and does not have a problem of quality deterioration. In addition, as described above, since the warp pile yarns have a strong yarn structure, they are formed into a towel that is resistant to fluff dropping. In addition, cotton fibers are arranged on the surface of warp pile yarns so that the water absorption and texture become favorable, and the core component fibers are polyester multifilament yarns so that the drying speed is fast. The core-sheath conjugate spun yarns are also called long and short conjugate spun yarns because core component fibers are polyester multifilament yarns, and sheath component fibers are cotton fibers.

The warp pile yarns are preferably bundled spun yarns. The bundled spun yarns are uniform yarns with a small amount of fluff, have a strong yarn structure, are strong against squeezing, and can be formed into a towel cloth without glue. In addition, the yarn speed is 300 to 450 m/min, and the productivity increases to about 10 to 20 times that of a ring spinning machine. This spinning machine is commercially available as, for example, "MURATA VORTEX SPINNER" (product name, commercially available from Murata Machinery, Ltd.).

Based on 100 mass % of the warp pile yarns, preferably, the mixing percentage of cotton fibers in the warp pile yarns is 70 to 90 mass %, and the mixing percentage of polyester multifilament yarns is 30 to 10 mass %. More preferably, the percentage of cotton fibers is 75 to 90 mass % and the percentage of polyester multifilament yarns is 25 to 10 mass %. Therefore, it is possible to achieve a balance between water absorption and hygroscopicity of the cotton fibers and the tenacity of the polyester multifilament yarns.

The polyester multifilament yarns are preferably grey yarns (raw yarns). The grey yarns are straight and easily enter the inside of long and short conjugate spun yarns.

The warp ground yarns are preferably two ply yarns formed of 100 mass % of cotton fibers. The two ply yarns reduce the occurrence of fluffing and are able to be woven into a loop pile towel cloth without glue. The warp ground yarns are preferably two ply yarns obtained by twisting two single ring spun yarns or bundled spun yarns.

The weft ground yarns are preferably single yarns formed of 100 mass % of cotton fibers. For the weft ground yarns, single ring spun yarns or bundled spun yarns are preferably used.

Based on 100 mass % of the towel cloth, preferably, the percentage of cotton fibers mixed in is 75 to 95 mass %, and the percentage of polyester multifilament yarns mixed in is 25 to 5 mass %. Therefore, it is possible to achieve a balance between water absorption and hygroscopicity of the cotton fibers and the tenacity of the polyester multifilament yarns. In addition, the mass per unit area (weight per unit area) of the towel cloth according to one embodiment of the present invention is preferably in a range of 100 to 600 g/m$^2$. Within the above range, it is easy to use it as a towel cloth.

A method of producing a towel cloth according to one embodiment of the present invention includes ungluing all of warp pile yarns, warp ground yarns and weft ground yarns and weaving them into a towel cloth using a loom. Examples of looms include an air jet loom, a water jet loom, a shuttle loom, and a rapier loom, and an air jet loom with the highest efficiency is preferable. The air loom can weave at a loom rotation speed of 300 to 500 r.p.m.

Pile yarns according to one embodiment of the present invention have a cotton count (S, single yarn) that is preferably in a range of 10 to 50 S (118 to 591 decitex). Within this range, the towel cloth may have favorable texture.

Hereinafter, description will be made with reference to the drawings. In the following drawings, the same reference numerals indicate the same components. FIG. 1A is a schematic side view of warp pile yarns 1 according to one embodiment of the present invention, and FIG. 1B is a schematic cross-sectional view of the same yarns. The warp pile yarns 1 are bundled spun yarn, core component fibers 2 are polyester multifilament yarns, and sheath component fibers 5 are cotton fibers. The sheath component fibers 5 include untwisted fibers 3 on the inner layer and wrapped fibers 4 on the surface layer. The wrapped fibers 4 on the surface layer are solid twisted in one direction and bundle all components. Thereby, the occurrence of fluff and sagging is reduced and the fibers do not fall off even if they are worn and maintain a tenacious yarn state. In the above description, one direction is a direction of S-twisted wrapped fibers or Z-twisted wrapped fibers, and does not mean that twist angles are the same. S-twisted wrapped fibers or Z-twisted wrapped fibers are determined according to a direction of a compressed air swirling flow of a spinner of a bundle spinning machine. The untwisted fibers 3 on the inner layer and the wrapped fibers 4 on the surface layer may be separate fibers or one fiber may be replaced by migration. The warp pile yarns (bundled spun yarns) 1 have a 3-layer structure including the core component fibers 2, the non-twisted inner layer fibers 3 of the sheath component fibers 5 and the surface layer wrapped fibers 4. According to this yarn structure, the yarn tenacity is high and the yarns are resistant to fluff dropping. In addition, cotton fibers are arranged on the surface of the warp pile yarns (bundled spun yarns) 1 so that the water absorption and texture become favorable, and the core component fibers are polyester multifilament yarns so that the drying speed is fast.

Figure 2:
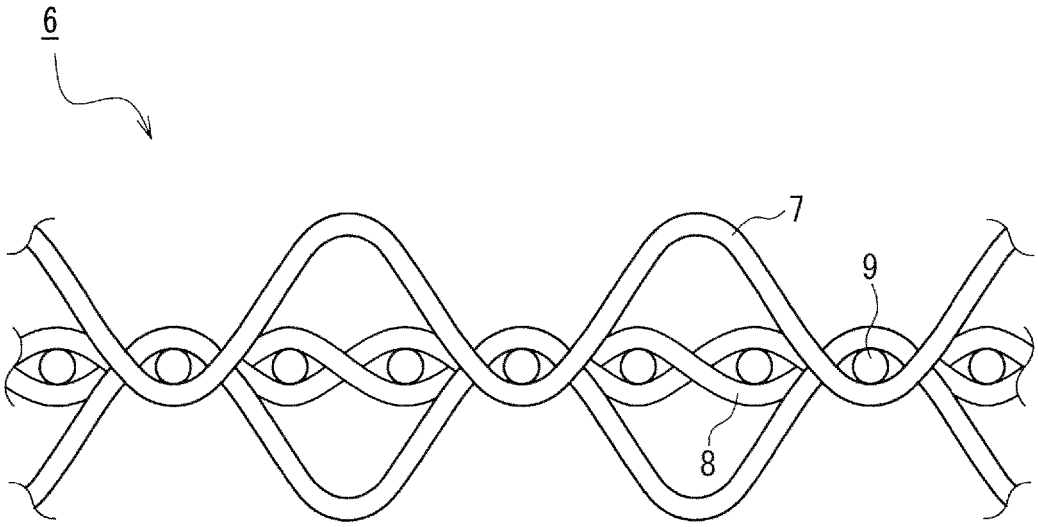
FIG. 2 is a schematic illustrative diagram of the same towel cloth.

FIG. 2 is a schematic illustrative diagram of a towel cloth 6 according to one embodiment of the present invention. The towel cloth 6 is composed of warp pile yarns 7, warp ground yarns 8, and weft ground yarns 9, and the warp pile yarns 7 form a loop pile while being fixed to a ground weave including the warp ground yarns 8 and the weft ground yarns 9. The obtained towel cloth 6 cut to a predetermined size and edges are treated to form a towel.

Figure 3:
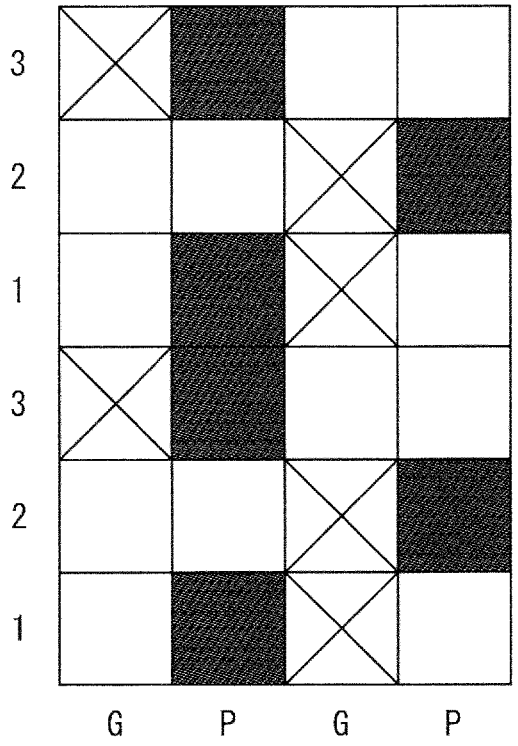
FIG. 3 is a fabric structure diagram of the same towel cloth.

FIG. 3 is a weave diagram of a towel cloth according to one embodiment of the present invention. This weave is a three-horizontal towel structure (three-pick ternary motion structure). The warp pile yarns cross once every three weft ground yarns. The warp ground yarns G and the warp pile yarns P are alternately arranged. The numbers 1 to 3 for the weft yarns indicate the order. In FIG. 3, black and x indicate floating yarns and white indicates sinking yarns.

Figure 4:
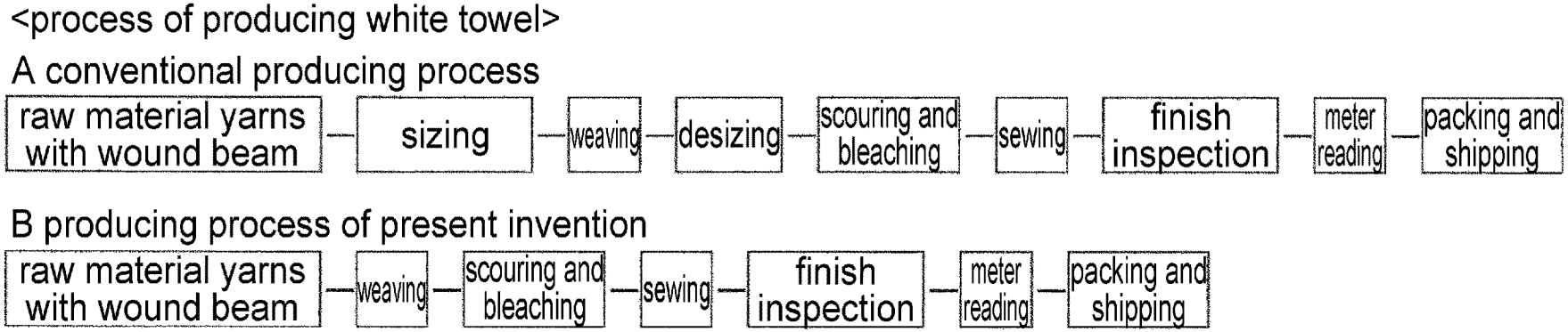
FIG. 4A is an illustrative diagram showing a process of producing a conventional white towel and FIG. 4B is an illustrative diagram showing a process of producing a white towel according to one embodiment of the present invention.

FIG. 4A is an illustrative diagram showing a process of producing a conventional white towel and FIG. 4B is an illustrative diagram showing a process of producing a white towel according to one embodiment of the present invention. In the towel producing process according to one embodiment of the present invention, a sizing process and a desizing process are unnecessary.

Figure 5:
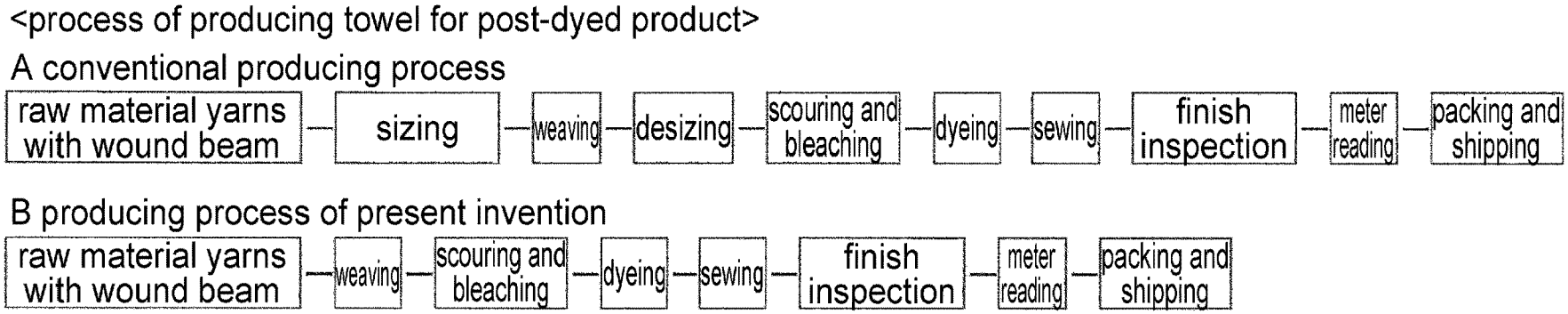
FIG. 5A is an illustrative diagram showing a conventional towel producing process for piece dyed products and FIG. 5B is an illustrative diagram showing the same process according to one embodiment of the present invention.
Figure 6:
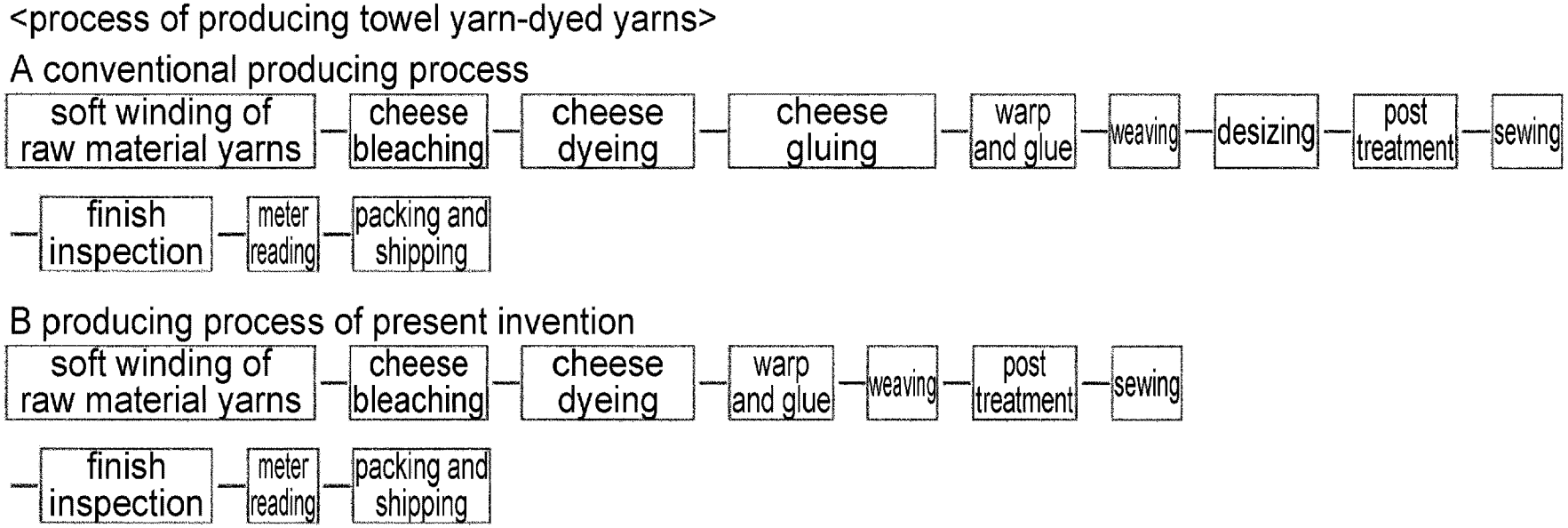
FIG. 6A is an illustrative diagram showing a conventional towel producing process for yarn-dyed yarns and FIG. 6B is an illustrative diagram showing the same process according to one embodiment of the present invention.

FIG. 5A is an illustrative diagram showing a conventional towel producing process for piece dyed products and FIG. 5B is an illustrative diagram showing the same process according to one embodiment of the present invention. In the towel producing process according to one embodiment of the present invention, a sizing process and a desizing process are unnecessary. FIG. 6A is an illustrative diagram showing a conventional towel producing process for yarn-dyed yarns and FIG. 6B is an illustrative diagram showing the same process according to one embodiment of the present invention. In the towel producing process according to one embodiment of the present invention, a gluing process and a desizing process are unnecessary.

EXAMPLES

Hereinafter, details will be described with reference to examples. The present invention is not limited to the following examples.

Measurement methods in examples and a comparative example according to the present invention are as follows, and measurement methods not described were performed according to industry standards.

<Dropping Fluff Rate>

The dropping fluff rate was measured according to the JIS L 0217 103 method.

<Drying Test>

Conditions: the test was performed under a standard state environment at a temperature of 20±4° C. and a relative humidity of 65±4% RH.

Water for immersion at a room temperature of 20° C.±15° C. (5 to 35° C.) was used.

In order to control the temperature and humidity, an air conditioner and a dehumidifier were used when determined to be appropriate.

The drying part was kept constant.

The dimensions and weight were actually measured values.

The time was used using a stopwatch.

Operations

1. Each specimen was put into a bucket containing water at room temperature, and after it was confirmed that the entire towel was completely immersed in water, immersion was maintained for 2 minutes.
2. After 2 minutes of immersion, water was naturally drained by performing lifting for 30 seconds.
3. Then, dehydration was performed for 4 minutes.
4. After dehydration, each specimen was put into a zipper bag and stored until the test examination started.
5. The weight of the specimen was measured at predetermined time intervals.
6. "Temperature and relative humidity" were recorded at the same time as the weight measurement.
7. The weight measurement was recorded at predetermined time intervals until the water retention rate dropped below 10%.

<Pile Retention>

The Pile Retention was Measured According to the JIS L 1075 B Method.

<Surface Water Absorption Method (Larose Index)>

The Larose index was measured according to the JIS L 1907 method. The Larose index (water absorption evaluation index) was calculated according to the following formula.

Larose index (water absorption evaluation index)= 2545×water absorption rate (ml/s)+water absorption amount (ml)+79

<Compression Test>

Figure 7:
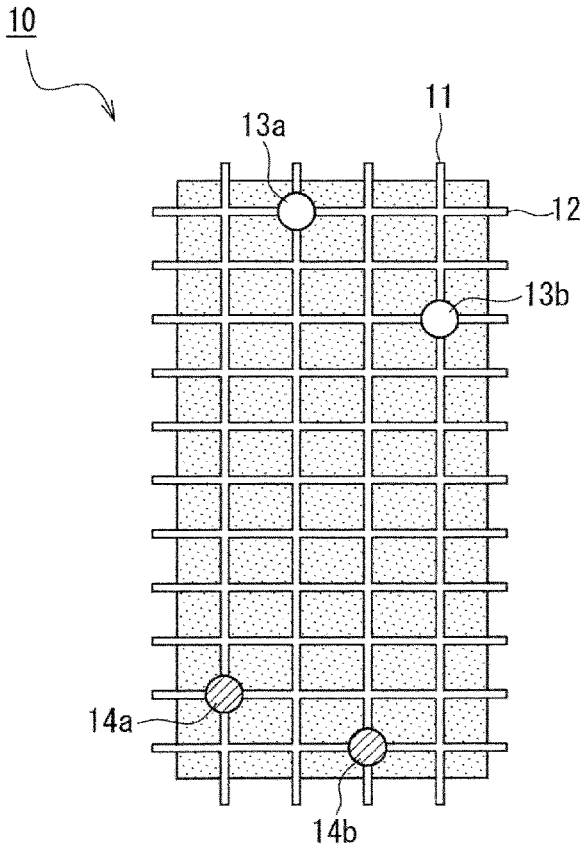
FIG. 7 is a schematic plan view showing measurement points in a bulkiness test and a compression test for a towel cloth.

A Kato Tech compression tester KES (Kawabata Evaluation System)-G5 was used, and measurement was performed with a 20 $cm^2$ compressor, an upper limit load of 50 $gf/cm^2$, and a compression speed of 0.5 mm/sec. As shown in FIG. 7, measurement points were positions at which warp yarns 11 and weft yarns 12 of a towel cloth 10 did not cross, and measurement was performed at surface measurement points 13*a* and 13*b* and back surface measurement points 14*a* and 14*b*.

Figure 8:
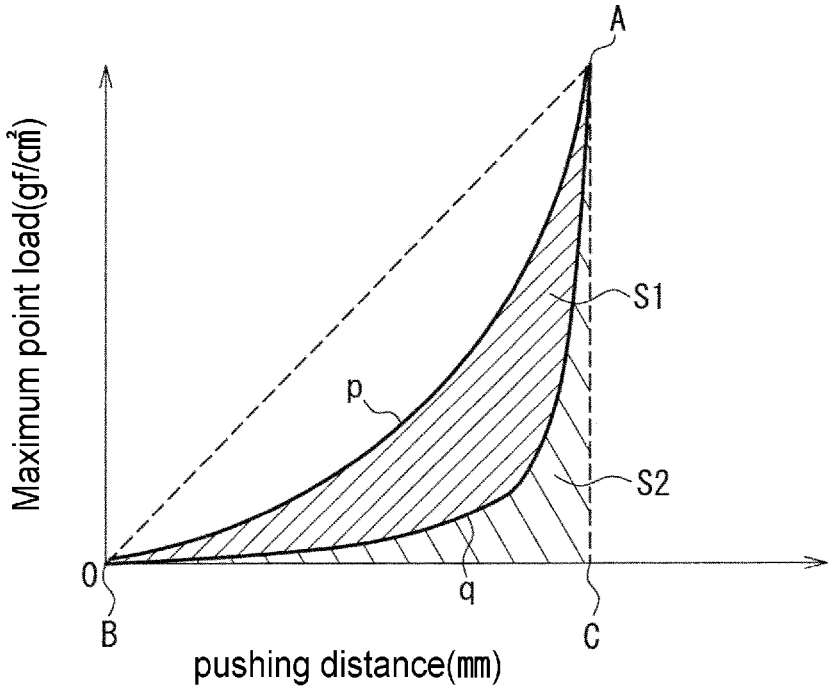
FIG. 8 is a graph for determining a WC value in a compression test used for examples of the present invention.

The measurement data included work of compression (WC), linearity of compression (LC), and recovery of compression (RC). In the sensory test, it was found that the WC value among them indicates the softness of the towel. The WC value indicates the area of S1 in the graph of FIG. 8. As the WC value is larger, compression is more likely to occur. That is, the sample has softness. In FIG. 8, B is the start time, A is the maximum point of pushing, C is the maximum distance of pushing, p is the load-distance curve during pushing (actually measured data), q is the load-distance curve during recovery (actually measured data), S1 is the area between the load-distance curve p during pushing and B-C and A-C, and S2 is the area between the load-distance curve q during recovery and B-C and A-C. The WC (work of compression) is a total area of the area S1 during pushing and the area S2 during recovery and is determined by the following formula.

$$WC = S1 + S2$$

<Bulkiness Test>

JIS L 1096.8.5 (testing methods for fabrics and knitted fabrics) and a thickness measuring instrument (model TH-2, commercially available from INTEC Inc.) specified in ISO 10012-1 were used, a presser foot with a diameter of 50.5 mm was used, a load of 0.7 KPa was applied, and a numerical value was measured after 10 seconds. As shown in FIG. 7, measurement points were positions at which warp yarns 11 and weft yarns 12 of a towel cloth 10 did not cross, and measurement was performed at surface measurement points 13*a* and 13*b* and back surface measurement points 14*a* and 14*b*. In addition, calculation was performed by the following formula.

$$Bu = (t/Sm) \times 1000$$

where, Bu: bulkiness ($cm^3/g$)

Sm: mass per unit area ($g/m^2$) under standard conditions t: thickness (mm)

Example 1

1. Fibers Used (1) Warp Pile Yarns

As core component fibers, polyethylene terephthalate (PET) multifilament grey yarns (total fineness 56 decitex, 48 fibers) were used.

As sheath component fibers, 100% combed cotton with a sliver thickness of 320 Gr/6 yd was used.

The above fibers were used, a spinning machine (product name "MURATA VORTEX SPINNER," commercially available from Murata Machinery, Ltd.) was used, PET multifilament grey yarns were supplied as a core component upstream from a front roller of a drafting machine and combined with a fiber bundle of 100% combed cotton as a sheath component to obtain long and short conjugate spun yarns having a cotton count of 16 S at a spinning speed of 400 m/min. The long and short conjugate spun yarns had a single yarn tenacity of 546.3 cN, an elongation of 7.55%, a cotton mixing percentage of 85 mass %, and a polyester mixing percentage of 15 mass %.

(2) Warp Ground Yarns

Ring spun yarns formed of 100 mass % of cotton fibers and two ply yarns having a cotton count of 30 (394 decitex) were used (30 S/2).

(3) Weft Yarns

Ring spun yarns formed of 100 mass % of cotton fibers, and single yarns having a cotton count of 20 S (295 decitex) were used (20 S/1).

2. Weaving of Towel Cloth

The warp pile yarns, warp ground yarns and weft ground yarns were used without glue (without sizing), and hung on an air loom and loop pile cloth fabrics shown in FIG. 2 and FIG. 3 were produced at 400 r.p.m. The supply ratio of the warp pile yarns was 7.5 times that of the warp ground yarns. In this manner, a double-sided pile towel having a warp yarn density of 60 yarns/2 inch, a weft yarn density of 42 yarns/inch, and a pile length of 1.06 cm was produced. The pile fabric cloth was scoured and bleached (desizing was unnecessary) and then heated in a tenter and finished. The mass per unit area (weight per unit area) of the towel was 417 g/m$^2$.

Example 2

The procedure was performed in the same manner as in Example 1 except that the spinning speed was 440 m/min, and the long and short conjugate spun yarns had a single yarn strength of 534.3 cN and an elongation of 4.35%.

Comparative Example 1

A towel was woven and desized in the same manner as in Example 1 except that, as warp pile yarns, 100% cotton ring spun yarns, and single yarns having a cotton count of 16 S were used and sizing was performed.

The above results are shown in Table 1.

TABLE 1

| | Example 1 | Example 2 | Comparative Example 1 |
|---|---|---|---|
| warp pile yarn | single yarns having cotton count of 16S cotton 85% PET 15% bundled spun yarns | single yarns having cotton count of 16S cotton 85%, PET 15% bundled spun yarns | single yarns having cotton court of 16S cotton 100% ring spun yarns |
| warp ground yarn | two ply yarns having cotton count of 30S cotton 100% | two ply yarns having cotton count of 30S cotton 100% | two ply yarns having cotton count of 30S cotton 100% |
| weft ground yarn | single yarns having cotton count of 20S cotton 100% | single yarns having cotton count of 20S cotton 100% | single yarns having cotton count of 20S cotton 100% |
| entire composition | cotton 90%, PET 10% | cotton 90%, PET 10% | cotton 100% |
| gluing | without gluing all constituent yarns | without gluing all constituent yarns | gluing all constituent yarns |
| mass (weight per unit area) (gm$^2$) | 417 | 415 | 426 |
| pile length (cm) | 1.06 | 1.06 | 1.06 |
| fluff dropping properties: dropping fluff rate (during washing once) | 0.016 | 0.02 | 0.09 |
| drying test (Hr) | 4 | 4 | 4.75 |
| pile retention power (cN) | 342.5 | 342.1 | 200 |
| Larose index (water absorption) | 716 | 777 | 403 |
| KES compression test (mm) | 2.72 | 3.19 | 2.21 |
| bulkiness (cm$^3$/g) | 9.90 | 9.92 | 7.65 |

As can be clearly understood from Table 1, Examples 1 to 2 could be woven without gluing all constituent yarns, and a glue removal process was unnecessary after the yarns were formed into a towel, and the cost could be reduced accordingly. In addition, all of fluff dropping properties, drying properties, pile retention power, water absorption, KES compression, and bulkiness of Examples 1 and 2 were better than those of Comparative Example 1. Since the warp pile yarns had a strong yarn structure, it was confirmed that the towel was resistant to fluff dropping. In addition, sensory evaluation was performed and it was found that the sample had water absorption intrinsic to cotton fibers, and a soft and fluffy texture.

In Examples 1 to 2, white towels were produced in the process shown in FIG. 4B. When comparing this with white towels for which the conventional sizing process and the desizing process shown in FIG. 4A were required under conditions of yarns used: 450 kg, 3,200 yarns, and a length of about 6,000 m/yarn, it was possible to reduce the amount of water used by about 15%, energy (electricity and natural gas) cost by about 17%, and $CO_2$ emissions (kg/KWh) by about 17%.

In addition, comparing the conventional towel producing process when the piece dyed yarns shown in FIG. 5A were used with the towel producing process according to one embodiment of the present invention in FIG. 5B under conditions of yarns used: 450 kg, 3,200 yarns, and a length of about 6,000 m/yarns, it was possible to reduce the amount of water used by about 9%, energy (electricity and natural gas) cost by about 15%, and $CO_2$ emissions (kg/KWh) by about 15%.

INDUSTRIAL APPLICABILITY

The towel cloth of the present invention is also suitable for towels such as bath towels, face towels, towel handkerchiefs, sports towels, bathrobes, and towel blankets, cloth, socks, rugs, and bedclothes.

REFERENCE SIGNS LIST

1, 7 Warp pile yarn (bundled spun yarn)
2 Core component fiber

3 Untwisted fiber
4 Wrapped fiber
5 Sheath component fiber
6, 10 Towel cloth
8 Warp ground yarn
9 Weft ground yarn
11 Warp yarn
12 Weft yarn
13*a*, 13*b* Surface measurement point
14*a*, 14*b* Back surface measurement point

What is claimed is:

1. A towel cloth comprising:

warp pile yarns, warp ground yarns, and weft ground yarns, wherein:

the warp pile yarns are bundled spun yarn that comprise core component fibers that are polyester multifilament yarns, and sheath component fibers that are cotton fibers;

the sheath component fibers comprise untwisted fibers on the core component fibers, and wrapped fibers on the untwisted fibers; and the wrapped fibers are wound in one direction to bundle all components.

2. The towel cloth according to claim 1, wherein, based on 100 mass % of the warp pile yarns, the mixing percentage of cotton fibers in the warp pile yarns is 70 to 90 mass %, and the mixing percentage of polyester multifilament yarns is 30 to 10 mass %.

3. The towel cloth according to claim 1, wherein the polyester multifilament yarns are grey yarns.

4. The towel cloth according to claim 1, wherein the warp ground yarns are two ply yarns formed of 100 mass % of cotton fibers.

5. The towel cloth according to claim 1, wherein the weft ground yarns are single yarns formed of 100 mass % of cotton fibers.

6. The towel cloth according to claim 1, wherein, based on 100 mass % of the towel cloth, the percentage of cotton fibers mixed in is 75 to 95 mass %, and the percentage of polyester multifilament yarns mixed in is 25 to 5 mass %.

7. A method of producing the towel cloth according to claim 1, comprising using a loom to weave all of the warp pile yarns, warp ground yarns and weft ground yarns into a towel cloth without glue.

8. The method of producing a towel cloth according to claim 7, wherein the loom is an air jet loom.

* * * * *